United States Patent [19]

Epstein et al.

[11] 4,156,431

[45] May 29, 1979

[54] SMOKE PROCESSING

[76] Inventors: Samuel S. Epstein, 880 N. Lakeshore Dr., Chicago, Ill. 60611; William Lijinsky, P.O. Box B, Frederick, Md. 21701

[21] Appl. No.: 782,423

[22] Filed: Mar. 29, 1977

Related U.S. Application Data

[63] Continuation-in-part of Ser. No. 160,786, Jul. 8, 1971, abandoned, and a continuation-in-part of Ser. No. 281,292, Aug. 17, 1972, abandoned, which is a continuation-in-part of Ser. No. 51,777, Jul. 2, 1970, abandoned.

[51] Int. CL.[2] ..... A24B 15/02; B01D 53/02

[52] U.S. Cl. ..... 131/10.7; 131/10.9; 131/140 R; 131/264; 131/265; 131/269; 55/74

[58] Field of Search ..... 131/264, 131/265, 266, 10 R, 10.7, 10.9, 261 R, 262 A, 269, 267; 55/74

[56] References Cited

U.S. PATENT DOCUMENTS

| | | | |
|---|---|---|---|
| 2,007,407 | 7/1935 | Sadtler | 131/264 |
| 3,003,504 | 10/1961 | Touey et al. | 131/269 |
| 3,217,715 | 11/1965 | Berger et al. | 131/267 |
| 3,280,823 | 10/1966 | Bavley et al. | 131/269 |
| 3,313,305 | 4/1967 | Noznick et al. | 131/264 |
| 3,434,479 | 3/1969 | Till et al. | 131/10.9 |

OTHER PUBLICATIONS

*Tobacco and Tobacco Smoke,* by Wynder et al., 1967, Academic Press, New York, N.Y., p. 436.

Article entitled, "Low Tar Nicotine Content Design", from the magazine *Tobacco,* 9/28/73, pp. 26 and 28.

*Primary Examiner*—Robert W. Michell
*Assistant Examiner*—V. Millin
*Attorney, Agent, or Firm*—Charles Hieken, Esq.

[57] ABSTRACT

An unsulfonated cross-linked polystyrene, silicic acid and a binder comprise a tobacco smoke filter for removing essentially all nitrosamines and secondary amines from the tobacco smoke passing through the tobacco filter attached to the normally unlighted end of the cigarette.

9 Claims, 1 Drawing Figure

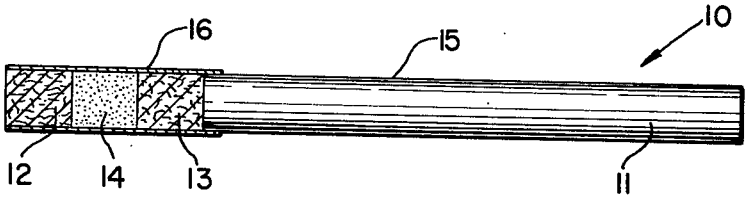
16
15
10
12
14
13
11

SMOKE PROCESSING

RELATED APPLICATIONS

This application is a continuation-in-part of applicants' copending U.S. application Ser. No. 160,786, filed July 8, 1971 now abandoned, and Ser. No. 281,292, filed Aug. 17, 1972 now abandoned, the former application being a continuation-in-part of applicants' U.S. application Ser. No. 51,777, filed July 2, 1970 now abandoned.

BACKGROUND OF THE INVENTION

The present invention relates in general to smoke processing and more particularly concerns novel apparatus and techniques for removing essentially all nitrosamines and secondary amines from tobacco smoke.

In TOBACCO for June 19, 1970, in an article entitled "The Smoking and Health Issue: Research Study Efforts Need to be Re-Oriented," it states on page 28:

> The presence or absence of the potent carcinogens nitrosamines in tobacco smoke is currently a controversial question. It has been assumed that secondary amines and oxides of nitrogen, present in tobacco smoke, could react and produce nitrosamines which might explain the tumorigenic activity of tobacco smoke in animals.
>
> These compounds were found in the smoke of cigarettes containing high levels of nitrates and volatile bases but not in the smoke from cigarettes with normal amounts of these leaf constituents. Further work indicated that all of the isolated nitrosamines may be artifacts formed in the smoke collection train and may not actually exist in the mainstream smoke. The nitric oxide present in cigarette smoke may be oxidized progressively to nitrogen dioxide in the traps and the combinations of oxides may react with amines to form the said nitrosamines. Consequently, no valid conclusion can be reached regarding the presence of nitrosamines in smoke immediately leaving the but end of a cigarette.

In NATURE for Jan. 3, 1970, applicants stated in an article entitled "Nitrosamines as Environmental Carcinogens" at page 23:

> Tobacco contains several secondary amines, particularly pyrrolidine to the extent of 0.01 percent. These amines could be released and ingested when tobacco is chewed, particularly when mixed with lime. Cigarette smoke contains many secondary amines, including pyrrolidine and piperidine. These amines could dissolve in the saliva during smoking and be converted to nitrosamines in the stomach. Such nitrosamines could be absorbed and give rise to tumours of the lung systemically, a property of several nitrosamines. Infra p. 53. (footnotes omitted)

With the aid of applicant Dr. Lijinsky nitrosamines in cigarette smoke condensate was positively identified and reported upon in a letter in NATURE for Apr. 7, 1972, pp. 307–08.

U.S. Pat. No. 3,903,898 granted Sept. 9, 1975, on an application filed May 21, 1974, is concerned with removing carcinogens found in tobacco smoke, but fails to mention secondary amines or nitrosamines or that essentially all of these substances should be removed from tobacco smoke. As recognized in that patent the concern of smokers with the possible presence in tobacco smoke of cancer-inducing components led to the development of various filtering materials for use in or with cigarettes, cigars and pipes, primarily designed to remove nicotine and the tarry components of cigarette smoke from the latter prior to its induction into the buccal cavity incorporated in cigarettes as so-called "filter tips", for replaceable use in cigarette and cigar holders and in the stems of pipes. The patentee there states in column 1 beginning at line 24:

> Unfortunately, it has been found that such prior art filters do not in fact remove or even sufficiently reduce the carcinogens present in tobacco smoke, that is, the components known to induce cancer and other disorders in rats.
>
> It has long been desired, therefore, and the object of many research projects of considerable cost to provide a tobacco smoke filter which is particularly effective against the carcinogens present in tobacco smoke while not eliminating therefrom the essential taste sought by tobacco smokers.

Among the prior art is Australian Pat. No. 287594 published Nov. 10, 1966, on an invention of Tynan et al. That patent discloses an annular flavour ring located between the cigarette body 10 and filter 11, the flavour ring being used in conjunction with Millipore and/or normal cellulose acetate filters. The flavour ring has one or more apertures for the passage of smoke, the size and arrangement being such as to accelerate smoke passing through and thereby causing the deosition from the smoke of tars, nicotine and particular matter, the material of the ring holding an essence or other flavouring substance which is given up to the smoke as the cigarette is smoked, the word ring meaning any form of disc, plate, tablet or the like having in it one or more apertures. This flavour ring is made like medicinal tablets, and the patent states:

> There are such a large number of organic powders well-known in the art as being capable of compression to tablet form that it is superflous to mention any one in particular.
>
> Among the inorganic powders capable of being compressed in such a manner are: —common inorganic salts such as sodium carbonate, sodium bicarbonate, calcium carbonate, sodium sulphate etc; oxides such as alumina, magnesia; siliceous materials such as Kieselguhr, diatomaceous earth, celite, silicic acid; ion exchangers such as Dowex 50, Zeo-Karb 226, Bio-rad Z P-1- Bio-rad Z T-1, Bio-rad Z M-1, Bio-rad AHP-1, selectacel; zeolites and molecular sieves, 4A, 5A, 13X; amorphous powders such as different types of vegetable and bone charcoal.
>
> In addition to the above a number of organic materials are available which can be readily pressed in the form of a tablet, some of which are the following: Ethyl Cellulose, polyethylene glycol of various molecular weights, polyvinyl pyrrolidone, sucrose fatty acid ester, cellulose acetate, potato and rice starch, crystalline and paper cellulose. (p. 5)

This patent does not discuss the carcinogenic effects of nitrosamines or secondary amines or removing essentially all nitrosamines and secondary amines from the tobacco smoke. Dowex 50 is a sulfonated styrene divinyl benzene colpolymer that is ineffective in removing nitrosamines from tobacco smoke. While the patent mentions silicic acid as an inorganic powder capable of being compressed into an annular tablet to form the annular flavour ring, the patent does not discuss using enough silicic acid to remove essentially all secondary amines from the tobacco smoke passing through the flavour ring, and the structure of the flavour ring is such that it could not remove essentially all secondary amines and nitrosamines because smoke passing through the opening in the flavour ring without contacting the surrounding chemicals will retain nitrosamines and secondary amines.

Another example of a prior art cigarette filter for removing tars and nicotine with high efficiency is disclosed in Noznick U.S. Pat. No. 3,313,305. That patent states:

> There can also be used granular absorbents such as silica gel and ion exchange resins, e.g. cation exchange resins such as sulfonated styrene-divinyl benzene copolymer (available commercially as Dowex 50), sulfonated phenolformaldehyde and ethylene glycol dimethacrylate-methacrylic acid copolymer and anion exchange resins such as phenol-tetraethylene pentamine-formaldehyde resin and quaternary ammonium resins prepared by reacting a tertiary amine with a haloalkylated cross-linked copolymer of a monovinyl hydrocarbon and a polyvinyl hydrocarbon, e.g. the reaction product of trimethyl amine with a chloromethylated cross-linked copolymer of 92% styrene and 8% divinyl benzene by weight (Amberlite IRA-400) (Column 2, lines 28–46).

Sadtler U.S. Pat. No. 2,007,407 discloses, "I have found that when such substances as colloidal silicic acid (known in the trade as 'silica gel') . . . are added to the tobacco in the course of manufacturing operations, that cigarettes made therefrom produce a much more agreeable smoke than when such substances, or any one or more of them, are absent (column 1, lines 45–column 2, line 2)." The silica gel there disclosed, because it is a dehydrating agent, commonly used industrially for this purpose, has the effect of tending to dry the smoke and is a substantially dehydrated colloidal silica that is neutral without affinity for basic amines.

Schreus U.S. Pat. No. 2,815,760 discloses a tobacco smoke filter and recommends using "secondary amines derived from polystyrene, such as for instance Amberlite IRA-400 . . . (column 2, lines 23–34)." This patent teaches that "no easily volatile amines or bases should be used because they would leave the filter during the smoking process, thus unfavorably affecting the aroma (column 3, 11. 64–66)." The patent does not mention carcinogens, nor that essentially all secondary amines and nitrosamines should be removed from the tobacco smoke.

It is an important object of this invention to provide a means and method for removing carcinogens from tobacco smoke.

It is a further object of this invention to provide a means and method for removing essentially all nitrosamines and secondary amines from tobacco smoke.

It is another object of the invention to achieve one or more of the preceding objects while also removing higher order amines from the tobacco smoke.

It is a further object of the invention to achieve one or more of the preceding objects with methods and means that are relatively inexpensive and may be used with relatively high efficiency.

SUMMARY OF THE INVENTION

According to the invention, a smoke filter contains a material for removing secondary amines in smoke such as tobacco smoke, which material is silicic acid. The smoke filter preferably comprises a mixture of silicic acid and a second material capable of removing nitrosamines from smoke. The second material is preferably an unsulfonated cross-linked polystyrene. The silicic acid and unsulfonated cross-linked polystyrene are preferably mixed together to form a granular porous mass having 90 to 50% by weight silicic acid and 10 to 50% by weight unsulfonated cross-linked polystyrene. Preferably from about 3 to about 45% by weight of the mixture of a non-reactive binder is incorporated in the mass.

In the method of this invention, smoke such as tobacco smoke is filtered by passing it through a porous filter comprising silicic acid in particulate form. Preferably, the smoke is passed through a porous mass formed of a mixture of unsulfonated cross-linked polystyrene, silicic acid and a non-reactive binder.

It is a feature of this invention that the silicic acid has a high affinity for basic secondary amines and is capable of removing them from cigarette smoke. The unsulfonated cross-linked polystyrene acts to remove nitrosamines from tobacco smoke. Small amounts of the filter material of this invention are effective to remove all secondary amines and nitrosamines from the amount of tobacco ordinarily used in a commercial cigarette. The filter material of this invention can be easily formulated into a porous, dry granular mass suitable for use as a filter. The filter material is useful for removing basic nitrogen compounds from a variety of differently constituted smokes such as smoke generated by cigarettes burning, cigar burning, pipe smoking, food processing and the like.

BRIEF DESCRIPTION OF THE DRAWING

The above and other objects, features and advantages of the present invention will be better understood from the following description when read in conjunction with the accompanying drawing in which the FIGURE is a semidiagrammatic view of a smoke filter of this invention incorporated in a conventional cigarette.

DETAILED DESCRIPTION OF PREFERRED EMBODIMENTS

Turning now to the drawing, a cigarette is indicated generally at 10 having a tobacco-filled section 11 and a filtering section defining smoke passageway plugs 12 and 13 carrying between them a preferred embodiment of a smoke filter 14 of this invention. Conventional cigarette paper 15 and tip paper 16 encase the cigarette.

The smoke filter 14 preferably comprises a substantially uniform mixture of particles formed into a porous mass containing from 90% to 50% by weight silicic acid, from 10% by 50% by weight of an unsulfonated cross-linked polystyrene, and from 3 to 45% by weight of the combined silicic acid and polystyrene of a nonreactive binder. The silicic acid ($H_2SiO_3$) is used in its dry particle form. The term "particle" as used in this specification is meant to include powders and irregular particles as well as uniform particles. The particle size of the silicic acid used is preferably at least 10 mesh (ASTM) and preferably varies from 10 to 200 mesh (ASTM).

The unsulfonated cross-linked polystyrene resin used can be conventional unsulfonated cross-linked polystyrene as is known for use as molecular sieve materials. The unsulfonated cross-linked polystyrene is cross-linked by standard procedures as known in the art. Preferably the unsulfonated cross-linked polystyrene is cross-linked by use of small amounts of divinyl monomers such as divinylbenzene which may include m-divinylbenzene and p-divinylbenzene. As known in the art, cross-linking can be carried out by aqueous suspension techniques using an initiator such as benzoyl peroxide and a dispersing agent such as carboxmethyl cellulose admixed with styrene and a small amount of divinylbenzene such as for example 0.01% divinylbenzene. Unsulfonated divinyl cross-linked polystyrenes suitable for use in this invention are well-known and described in the literature as in the Journal of Physical Chemistry, Vol. 68, pp. 1776 et seq. (1964) R. H. Wiley et al. Chromosorb 103, a product of Johns-Mansville Company and Bio-Beads SM-2 and SX-8, products of Bio-Rad Laboratories of Richmond, Calif., are examples of unsulfonated cross-linked polystyrenes useful in this invention.

The unsulfonated cross-linked polystyrene is used to absorb nitrosamines normally occurring in tobacco smoke which nitrosamines include nitrosodimethylamine (dimethylnitrosamine or DMN), nitrosopyrrolidine and nitroso-N-methylbutylamine. Such nitrosamines are known to have irritating and deleterious effects on the body of an individual. The polystyrene is preferably used in particle form having a mesh size of from 10 to 200 mesh (ASTM).

The binder used is preferably non-reactive with the silicic acid, polystyrene and smoke passed through the filter. Its purpose is simply a means of holding together the silicic acid and polystyrene in larger particle size than would be possible if no binder is used. The larger particle size is desirable to enhance ease of gas or smoke passage through the filter. If the binder is not used, the silicic acid and polystyrene tend to powder making smoke passage difficult.

Various known non-reactive binders can be used such as powdered starch and anhydrous salts including calcium sulfate and magnesium sulfate. Starch or calcium sulfate are preferred for use because they are inexpensive. In most cases, it is preferred to use the binder in an amount of from 3 to 45% by weight of the combined mixture of silicic acid and polystyrene.

In forming the smoke filter 14, the unsulfonated cross-linked polystyrene resin, silicic acid and binder in desired proportions are uniformly mixed with water to form a thick but stirrable mass with 50 to 100% of the volume being solids. The moist mass is then allowed to air dry as at standard room temperature. After drying, the mass is mechanically broken up as with a spatula into particles preferably having sizes of from 1/50 to 1 cubic millimeter and preferably ½ cubic millimeter. These particles do not fall apart nor crumble easily and retain their size and shape over long time periods. Masses formed of the final particles allow substantially free flow of gas when packed into narrow tubes.

A porous mass as formed above can be maintained in place by conventional porous materials as known in the cigarette art. For example, plugs 12 and 13 of FIG. 1 can be loosely packed cotton or filter paper, rolled papers and the like. The combination of silicic acid and unsulfonated cross-linked polystyrene is particularly desirable since an inexpensive, highly effective smoke filter can be easily formed with the required porosity for effective filtering without impairing desired properties of the smoke.

In some cases, the silicic acid and unsulfonated cross-linked polystyrene can be uniformly mixed and incorporated into a porous support material such as cotton fibers to act as filters with or without a binder and with or without previously forming a moist mass first.

In a specific example of this invention, silicic acid having a uniform particle size of 10 mesh is uniformly admixed with unsulfonated cross-linked polystyrene resin particles having a uniform 10 mesh particle size. The unsulfonated cross-linked polystyrene is BioBeads SX-8, an unsulfonated cross-linked polystyrene resin. The silicic acid is used in an amount of 4 parts silicic acid to 1 part unsulfonated cross-linked polystyrene. 35% by weight of the mixture of powdered anhydrous calcium sulfate is uniformly admixed. The mixture is stirred with water at 75% by volume solids and then air dried at room temperature for 24 hours. Particles of about ½ cubic millimeter volume are formed by breaking up the resultant mass with a spatula. 200 milligrams of the mixture are packed, without breaking the particles, between elements 12 and 13 to form a smoke filter in a standard cigarette having an inside diameter of approximately 5/8 inch. The filter 14 has a length of approximately 10 millimeters. When the cigarette is ignited and smoked by an individual, it is found that smoke passing through the filter is purified by removal of nitrosamines and secondary amines along with some removal of primary and tertiary amines including nicotine. Specific basic secondary amines removed include dimethylamine, pyrrolidine and piperidine and specific nitrosamines include nitrosodimethylamine, nitrosopyrrolidine, and nitroso-N-methylbutylamine. When the cigarette contains 1 gram of tobacco, all secondary amines and nitrosamines occurring in the smoke are removed by the filter which will retain a minimum of 8 milligrams of secondary amines and a minimum of 5 milligrams of nitrosamines. These amounts are far in excess of the capacity of the tobacco used in the normal cigarette to produce equivalent amounts of nitrosamine or secondary amine. In fact, as little as 50 milligrams of the smoke filter material 14 of this invention is adequate to remove harmful ingredients from the smoke of an average cigarette.

In an experiment constituting a further specific example of the practice of the invention, particles comprising a mixture of silicic acid and polystyrene were prepared in essentially the same manner as in the preceding specific example. Two hundred milligrams of such particles were packed in glass tubes of approximately 6 mm. inner diameter. Five such glass tubes were packed. The particles in each tube were retained by a plug of glass wool at each end. Dimethylamine vapor was passed through each tube from a vessel of the anhydrous liquid for 3–4 minutes. Each tube was weighed before and after passage of the dimethylamine. The increase in weight was a measure of the dimethylamine absorbed.

In five experiments the weight increases were 7.0, 5.6, 8.8, 9.8 and 10.6 mg., or an average of 8.4 mg. per 200 mg. of particles.

The same five tubes packed with granules that had absorbed dimethylamine were used for study of nitrosamine absorption. Because the presence of amine might affect nitrosamine absorption (even though reflecting conditions of use in filtering cigarette smoke), two additional tubes were packed with 200 mg. each of fresh particles.

Dimethylnitrosamine vapor was generated by warming the liquid in a flask and was blown through the tubes by a gentle stream of dry nitrogen. After 2–3 minutes, the tubes were removed and allowed to stand for several days at room temperature to permit evaporation of condensed nitrosamine.

At the end of this time the particles were shaken from the tube into a flask and the nitrosamine was extracted by gentle shaking in 20 ml. of ethanol/water (1:3). The dimethylnitrosamine present was estimated by absorption spectrometry at 332 nanometers.

The results were 5.0, 4.6, 4.8, 6.8 and 3.2 mg. of dimethylnitrosamine absorbed in each 200 mg. of particles that had been saturated with dimethylamine and 13.0 and 5.2 mg. absorbed in the 200 mg. of fresh particles. The average weight of nitrosamine absorbed was 4.9 mg. per 200 mg. of particles for the first 5 samples, or 6.1 mg. per 200 mg. of particles for the 7 samples.

We estimate that the nitrosamine content of cigarette smoke is of the order of $1\times10^{-5}$ mg. per cigarette and that amines content—excepting nicotine—is generally no greater than 5% (by weight) of the tar, thus amounting to less than 1 mg. per cigarette. Therefore, a filter having 50 mg. of particles prepared as in the preceding specific examples would afford adequate sorbing capacity for all of the volatile amines and nitrosamines from the smoke of one cigarette. It is probable that not all of the nicotine in a cigarette is absorbed and therefore, in accordance with the present invention, as applied to the filtering of cigarette smoke, a filter charge of 50 mg. of particulate mixtures of silicic acid and polystyrene as described herein, in combination with additional nicotine filter means readily available within the state of the art, should be used.

A further specific example of practice of the present invention, embodying a distinctly advantageous improvement therein in respect of cigarette taste or flavor is now described. Thirty grams of the unsulfonated cross-linked polystyrene polymer, other samples of which were used in the foregoing specific examples, were placed in a 125 ml. Erlenmeyer flask. The flask was then partially filled (by the addition of approximately 75 ml.) with absolute methanol and closed and vigorously shaken. It was then allowed to stand, with occasional shaking, for 2 hours. This formed a suspension of the polystyrene polymer solids in the methanol liquid. The suspension was filtered and the solid filtrate was washed with 20–25 ml. of methanol. The resultant washed solid was used as solid starting material for a repetition of the above processing. The repeated suspension in, and washing with, methanol was terminated by an air drying step. The polystyrene particles so obtained are usable as the starting material in the manufacturing steps described above.

The treatment of polystyrene with methanol—or with alternative solvents—described above had the purpose of removing styrene monomer and selection of the polystyrene starting material, or treatment as described above, avoids or removes the source of this rubber-like flavor. It will be apparent to those skilled in the art that for mass production purposes, solvent recovery steps and/or the use of optimally lower amounts of solvent can be implemented.

It is a feature of this invention that the silicic acid and unsulfonated cross-linked polystyrene can together form a mass of sufficient porosity to permit passage of cigarette smoke therethrough at normal pressure differentials, as in the range of from ½ to 4 lbs./sq. inch. The filter material will not swell or change physically with time or when exposed to moist gases. Thus it does not act as a dehydrating agent which might have the effect of drying the tobacco smoke. Moreover, the smoke passing to the mouth of a user retains a flavorful taste.

Although a specific embodiment of this invention has been shown and described, many variations are possible. The specific mechanism for holding the preferred filter material mixture of this invention can vary considerably. In some cases, the filter material can be suspended on a mechanical backer such as paper having passageways therethrough and the like. The specific amount of filter material used and its porosity will vary greatly depending upon the particular usage. For example, in removing secondary amines and nitrosamines and other undesirable products from smoke, filters can be designed of large size to accomplish a desired removal objective as in smoke-filled rooms and the like. In some cases, the silicic acid can be used alone to permit removal of secondary amines from smoke in a suitable filter arrangement. In all cases, it is preferred that the filter 14 have sufficient porosity to permit gas flow at a rate of from 1 to 20 liters per minute at pressure differentials at one face of the filter to its opposite face of from ½ to 4 lb./sq. in.

It is evident that those skilled in the art, once given the benefit of the foregoing disclosure, may now make numerous uses and modifications of and departures from the specific embodiments described herein, without departing from the concept of the invention. Accordingly, the invention is to be construed as embracing each and every novel feature and novel combination of features present in or possessed by the apparatus and techniques herein disclosed and limited solely by the spirit and scope of the appended claims.

What is claimed is:

1. In combination with a container of tobacco to be smoked having lit and unlit ends when the container is lit at the lit end a tobacco smoke filter at the unlit end of the container comprising, first means for removing essentially all nitrosamines from tobacco smoke passing through said smoke filter for inhalation by a smoker, and second means for removing essentially all secondary amines from said tobacco smoke, whereby the smoke inhaled by a smoker when drawing through said filter with said lit end ignited is essentially free from nitrosamines and secondary amines.

2. The combination in accordance with claim 1 wherein said tobacco filter spans the full cross section of the smoke path between said lit end and the end of said smoke filter so that all the smoke produced by tobacco burning in said container contacts said first-mentioned and second-mentioned means so that the smoke entering a smoker drawing upon the unlit end is essentially free of nitrosamines and secondary amines.

3. The combination in accordance with claim 1 wherein said first-mentioned means is unsulfonated cross-linked polystyrene resin means, and said second-mentioned means is silicic acid.

4. The combination in accordance with claim 3 wherein said silicic acid is present in granular form having a particle size of from about 10 to about 200 mesh.

5. The combination in accordance with claim 3 wherein said unsulfonated cross-linked polystyrene is present in granular form having a particle size of from about 10 to about 200 mesh.

6. The combination in accordance with claim 3 wherein said filter material consists essentially of particles of 1/50 to 1 cubic mm. volume comprising from 10 to 50% by weight of unsulfonated cross-linked polystyrene, from 90 to 50% by weight of silicic acid and from 3 to 45% by weight of the unsulfonated cross-linked polystyrene and silicic acid of a binder which is free from reaction with silicic acid, polystyrene and the tobacco smoke under smoking conditions, the said ingredients being in substantially uniformly mixed admixture within the particles.

7. The combination in accordance with claim 5 wherein said silicic acid is present in an amount of substantially 80% by weight and said unsulfonated cross-linked polystyrene is present in an amount of substantially 20% by weight of the total material.

8. A method of using the combination of claim 1 including the steps of, igniting said lit end to produce tobacco smoke having nitrosamines and secondary amines, and drawing upon the end of said tobacco filter to cause said tobacco smoke to pass through said first means and said second means and exit through said filter essentially free of said nitrosamines and secondary amines.

9. A method in accordance with claim 8 wherein said smoke passes through said first and second means at a rate of from 1 to 20 liters per minute at a pressure differential of from ½ to 4 lbs. per square inch.

* * * * *